United States Patent [19]

Tsunoda

[11] 3,968,581

[45] July 13, 1976

[54] STEAM PRESSER

[76] Inventor: Fukuyuki Tsunoda, 644, Iizuka-Cho, Katsusika, Tokyo, Japan

[22] Filed: Aug. 4, 1975

[21] Appl. No.: 601,294

[30] Foreign Application Priority Data

Aug. 6, 1974 Japan ..... 49-90440

[52] U.S. Cl. ..... 38/15

[51] Int. Cl.[2] ..... D06F 71/34

[58] Field of Search ..... 38/14, 15, 1.6, 17, 38/3, 66, 27, 28, 71, 72, 25; 100/73

[56] References Cited

UNITED STATES PATENTS

| | | | |
|---|---|---|---|
| 2,490,618 | 12/1949 | Caplan | 38/15 |
| 3,758,968 | 9/1973 | Nagata et al. | 38/15 |

*Primary Examiner*—G. V. Larkin
*Attorney, Agent, or Firm*—Robert E. Burns; Emmanuel J. Lobato; Bruce L. Adams

[57] ABSTRACT

A steam presser for finishing garments, etc. The presser comprises a steam-spouting press table, a steam-generating chamber of the heat-plate type disposed under the steam-spouting press table, compressive water-feed valve means mounted on the steam-generating chamber, and waste steam suction means disposed beside the steam-generating chamber. In operation, a necessary amount of water is fed into the steam-generating chamber by means of the compressive water-feed valve means against the steam pressure in the chamber. Steam produced in the steam-generating chamber is spouted out through the mattress of the press table to effect the finish of the materials pressed between the mattress and the cover plate of the press table. The steam suction means further enhances the finishing effect by sucking away the steam permeated into the materials.

2 Claims, 4 Drawing Figures

FIG. 2
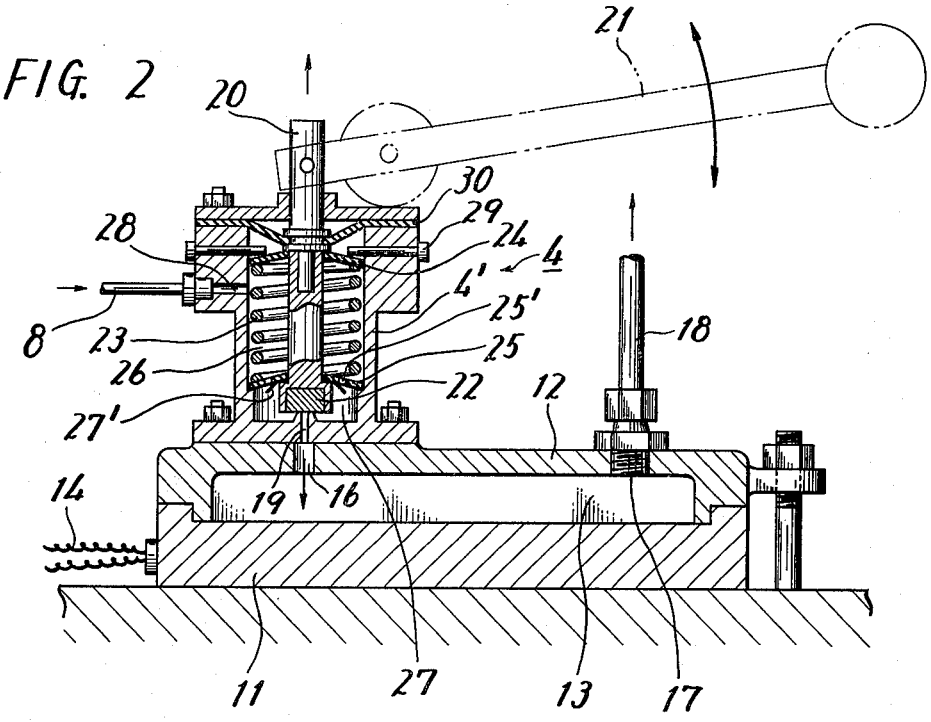
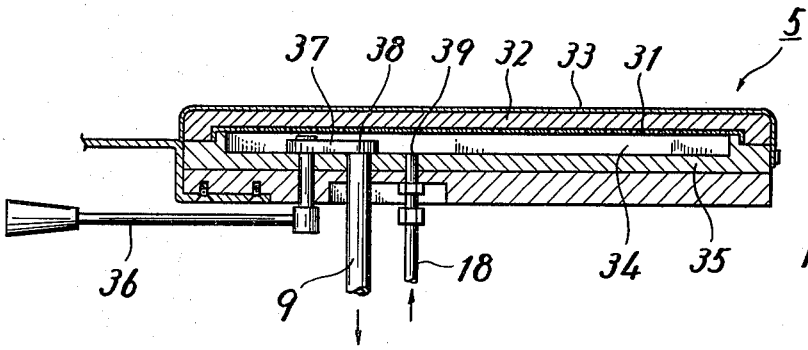
FIG. 3
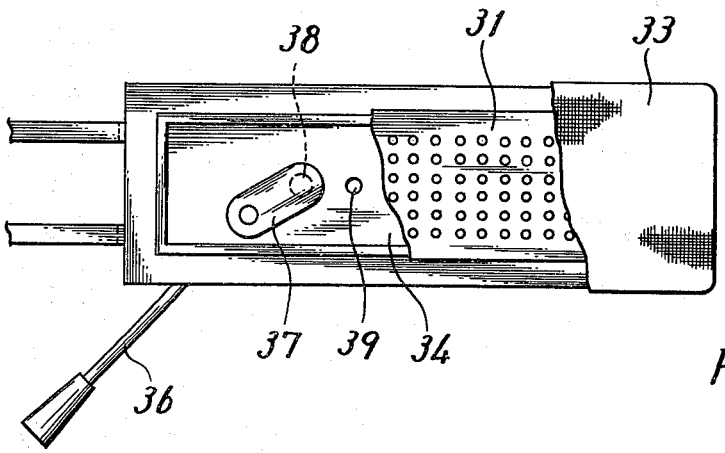
FIG. 4

STEAM PRESSER

BACKGROUND OF THE INVENTION

This invention relates to a steam presser which is compact in construction and adapted to domestic use.

Steam pressers are now widely used in the finish of garments, etc. Most of the conventional steam pressers, however, are of the type in which steam used in pressing is produced separately in a fuel-oil or electric boiler and piped to the presser and, thus being large in size and high in costs due to a plurality of units used together, are unsuitable for general use in the home, except for manufacturers, such as sewing and laundry, who need such pressers professionally.

This invention was accomplished as a result of the inventor's continuous studies on the presser, for the purpose of obtaining a steam presser which is particularly adapted to the use in the home, and by the finding that a steam generator of a heat-plate type, which has been proposed previously, will permit a compact arrangement in combination with the necessary devices of the presser.

SUMMARY OF THE INVENTION

It is an object of the invention to provide a steam presser which is compact in construction owing to the use of a heat-plate type steam generating chamber in place of a conventional large-sized steam boiler and which is usable not only in particular professions but also widely and readily in the home.

Another object of the invention is to provide a steam presser of simple construction having a high steam-generating efficiency and having an ability to feed water into the steam-generating chamber even with raised steam pressures in the chamber, without raising the pressure-head of the water tank by placing it high above the presser, because of a combination of a steam-generating chamber of the heat-plate type with compressive water-feed valve means.

Still another object of the invention is to provide a steam presser of high performance which can effect a high finishing efficiency and a soft finish of materials to be finished, by securing good permeability of steam in the materials and by removing in a moment the steam permeated into them.

Another object of the invention is to provide a steam presser with a construction adapted to the use in the home, preventing the flowout of the steam in the room and thus preventing the pollution of the room.

According to the present invention, there is provided a steam presser comprising a steam-generating chamber of heat-plate type, water tank, compressive water-feed valve means, and steam-spouting press table, and further provided with suction means and discharge means of waste steam, all of them being compactly arranged.

BRIEF DESCRIPTION OF THE DRAWINGS

The further objects and features of the invention will be apparent from the following description of an embodiment of the invention, taken in connection with the accompanying drawings. It should, however, be explicitly understood that various changes in the minor details of construction, within the scope of the claims, may be resorted to without departing from the spirit of the invention.

Now, referring to the drawings:

FIG. 2 is a sectional view illustrating a steam-generating chamber and compressive water-feed valve means of the steam presser according to the invention.

FIG. 3 is a sectional view showing an example of steam-spouting press table of the steam presser according to the invention; and FIG. 4 is a plan view partially in section of the steam-spouting press table shown in FIG. 3.

DESCRIPTION OF THE PREFERRED EMBODIMENT

Figure 1:
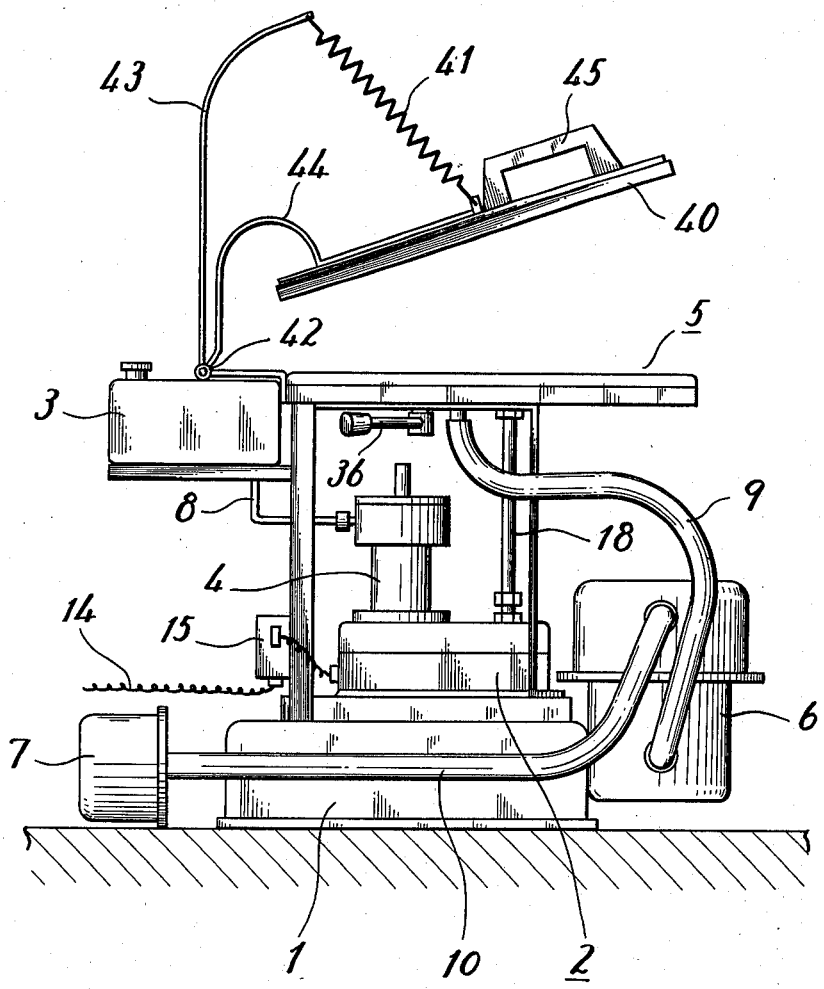
FIG. 1 is a front elevation showing the outside view of a steam presser according to the invention.

In FIG. 1, there are shown a base 1, steam-generating chamber 2, water tank 3, compressive water-feed valve means 4 for feeding required amounts of water from the water tank 3. to the steam generating chamber 2, a steam-spouting press table 5, steam suction means 6, and waste-steam tank 7, all these parts constituting in combination the steam presser of the invention.

The details of each of above described presser parts and the mode of connection between them will be illustrated below.

a. Steam generating chamber

The steam generating chamber 2 is situated under the steam-spouting press table 5 and mounted on the base 1 at the bottom of the presser, and, as shown in FIG. 2, is composed of a heat plate 11 comprising an iron disk, and a lid plate 12 having a shape similar to that of the heat plate 11 and fitted to the heat plate to define a steam generating space 13 therebetween.

The heat plate is normally provided with a electric heating wire (not shown) connected with cord wires 14 to the power source through a thermostat means 15 to control the temperature of the heat plate in a range from 200° to 200°C. The lid plate 12, on the other hand, has a water injection hole 16 and a steam-spouting hole 17 communicating respectively with the water-outlet hole 19 at the bottom of the compressive water-feed valve means 4 and with the steam conduit pipe 18 to the steam-spouting press table 5, as described hereinafter, so that an amount of water fed from the water-outlet hole 19 of the compressive water-feed valve means 4, on touching the heat plate 11, is converted in a moment into steam and led through the conduit pipe 18 to the steam-spouting press table 5 with a strong pressure rapidly increasing in the confined steam generating space 13.

b. Compressive water-feed valve means

The compressive water-feed valve means 4 is mounted on the steam generating chamber 2 and communicates through a water supply pipe 8 with the water tank 3, situated higher beside it, to receive a necessary amount of water from the water tank 3 and to feed it into the steam-generating chamber 2. It comprises a cylindrical body 4' mounted vertically on the steam-generating chamber 2 and a rod 20 slidably inserted into the cylindrical body 4' along its axis, the rod 20 being, at its upper end, detachably hinged by means of a pin with a lever 21 for moving the rod 20 up and down, and, at its lower end, provided with a seal 22 for making the water-outlet hole 19 on the bottom wall of the body 4' open or closed so that the water-outlet hole 19 is open when the rod 20 is drawn up and closed when the rod is pushed down. At the intermediate portion of the rod 20, there are provided slidably an upper partition plate 24 and a lower partition plate 25 with a certain distance and separably pushed from each other by a spring 23, the upper and lower partition plates 24 25 defining an upper water chamber 26 therebetween and between the wall of the cylindrical body 4' including a water supply hole which communicates with the water supply pipe 8.

On the other hand, a lower water chamber 27 is defined between the lower partition plate 25 and the bottom wall portion of the cylindrical body 4'. On the lower partition plate 25 are provided holes 25' for communicating water between the upper water chamber 26 and lower water chamber 27, each hole 25' being attached with a valve 27' which opens only when the pressure in the upper water chamber 26 is increased, so that the water in the upper water chamber 26 is transferred through the opened valves into the lower water chamber 27 when the upper water chamber 26 is compressed by the operation of the lever 21 against the spring 23, and, when the upper water chamber 26 is expanded, water is taken into the chamber from the water tank 3 and the water in the lower water chamber 27 is pushed through the water-outlet hole 19 into the steam-generating chamber 2 with the valves 27' closed. In FIG. 2, the numeral 29 indicates stoppers and the numeral 30, a sealing piece.

It is advisable that the body of the compressive water-feed valve means 4 be formed of a pressure-resistant vessel and a vent be provided on the top lid.

c. Steam-spouting press table

The steam-spouting press table comprises a rectangular box-type steam-spouting press member 5 situated over the steam-generating chamber 2 and a cover plate 40 of brass-make swingably attached at a hinge shaft 42 through a bracket 44 to the press table and held through a spring 41 at the top of a fixed bracket 43. The press member 5 is composed of a soft mattress member 32 covered with a cloth 33 and a bottom plate 35, defining a steam chamber 34 therebetween. The bottom of the mattress member 32 i.e. the ceiling of the steam chamber 34 is made of a porous member 31, so that the steam sent into the steam chamber 34 spouts through the porous member 31 and permeates through the mattress member 32 to finish the material pressed on the mattress member.

On the other hand, the bottom plate 35 of the press member 5, as illustrated, is provided with a suction opening 38 communicating with a steam suction pipe 9 and a steam injection opening 39 communicating with the steam conduit pipe 18, and on the suction opening 38 there is provided a door plate 37 which closes or opens the suction opening 38 by the operation of a lever 36 equipped on the under side of the plate 35, thus closing the suction opening 38 while the steam is being sent in from the steam injection opening 39 and opening while the steam is not injected, to exhaust waste steam from the the suction pipe 9. In FIG. 1, the numeral 45 indicates the handle of the cover plate 40.

d. Suction means of waste steam

As the suction means of steam 6 is employed, for example, a suction pump with motor and installed under the steam-spouting press table 5, beside the steam-generating chamber 2. The suction means 6 communicates at its lower portion with the suction opening 38 on the bottom of the steam-spouting press table 5 through the suction pipe 9, while the upper portion of the suction means 6 is connected through a steam-discharge pipe 10 to the waste-steam tank 7 disposed beside the base 1, so that the waste steam sucked by the suction means 6 is sent into the tank 7 to be stored therein.

When the opening 38 on the bottom of press table is made open, the steam permeated and remaining in the material to be finished and in the mattress member 32 is sucked away by the suction means within several seconds, and thus smoothing-out and fold or crease setting of the material are effected.

The mode of operation of the steam presser according to the invention will hereinafter be described. Materials to be finished, such as trousers, skirts, etc., are first placed on the steam-spouting press table 5 and pressed with the cover plate 40. The heat plate is heated with the power source switched on and the lever 21 is joined on top of the compressive water-feed valve means 4 and moved up and down to feed water intermittently to the heat plate 11 to produce steam. The generated steam goes up through the steam conduit pipe 18 into the steam chamber 34 in the press table 5 and after filling the space, permeates through the porous member 31 and through the mattress member 32 into the material and thus effects smoothing-out of wrinkles and fold or crease setting of the material, during which the door plate 37 is closed.

Thereafter, the lever 36 is operated to open the door plate 37 and the steam used in finish is sucked away by the suction means 6 through the suction pipe 9, further enhancing the finishing effect. Thus, the pressing operation is repeated in a sequence, steam-generating — finishing — steam-sucking, and in the end the power source is switched off, the cover plate 40 is made open, and the finished materials are taken out. The waste steam produced during operation is collected into the waste-steam tank, so that it never flows out in the room or pollutes the room.

The steam presser according to the invention is very compact in construction because of the steam-spouting press table, steam-generating chamber, water tank, compressive water-feed valve means, steam suction means, and waste-steam tank, each arranged in a suitable position, and does not require such a large-sized steam-generating means as used in the conventional pressers. Thus, it has a simple construction adapted to the use in the home, and has various advantages. The steam-generating chamber, owing to its mechanism such that a necessary amount of water is dropped on the heat plate from the compressive water-feed valve, permits instantaneous and effective generation of steam, and the compressive water-feed valve means makes it possible to feed water on the heat plate against a raised steam pressure in the steam-generating chamber, so that pressurizing of supply water by lifting the water tank high above the presser, as in the case of conventional methods, is made unnecessary, thus eliminating troublesome handling of the water tank and possible troubles during it, such as dropping of tank, leakage of water, etc.

In addition, the steam presser of the invention, having the suction means under the press table, can attain more effectively a beautiful finish of the material, smoothing-out of wrinkles and good creasing, by sucking away in a moment the steam permeated and remaining in the material, and, in combination with the effect of steam spouting and permeating, a soft finish of the material can be obtained. Further, the presser has also an advantage that the waste tank collects the waste steam so as to prevent it from flowing out in the room and from polluting the room. The presser of the invention, therefore, is particularly adapted to the practical use in the home as a steam presser of simple construction.

What I claim is:

1. A steam presser comprising, a steam-spouting press table composed of a mattress member including a steam chamber; a steam-generating chamber disposed under the steam-spouting press table, a base mounting said steam-generating chamber, said steam-generating chamber comprising a heat plate and a lid plate fitted over the heat plate to define a steam-generating space therebetween; compressive water-feed valve means mounted on said steam-generating chamber for feeding necessary amounts of water to the steam-generating chamber; a water tank situated at a higher position beside the compressive water-feed valve means and communicating with said compressive water-feed valve means; a water supply pipe providing communication between said water tank and said water-feed valve; suction means for waste steam disposed beside the steam-generating chamber and communicating with the bottom of said steam-spouting press table; a suction pipe providing communication between said suction means and said steam-spouting press table; a waste-steam tank disposed beside the base and connected to said suction means; and a discharge pipe for discharging the waste steam sucked by the suction means into said waste steam tank.

2. A steam presser which comprises:

a. a steam-generating chamber mounted on a base and comprising a heat plate heated by an electrical heater and a lid plate fitted over the heat plate to define a steam-generating space therebetween, said lid plate being provided with a water-injection hole and a steam-spouting hole;

b. compressive water-feed valve means for feeding necessary amounts of water to said steam-generating chamber, comprising a cylindrical body mounted vertically on the steam-generating chamber and a rod slidably inserted into the cylindrical body along its axis, a lever attached at an upper end of said rod for moving the rod up and down; said rod having at its lower end a seal for opening and closing the water-injection hole on said steam-generating chamber, at the imtermediate portion of the rod there being provided slidably an upper partition plate and a lower partition plate with a certain distance, a spring biasing the lower partition plate and upper partition plate away from each other, the upper and lower partition plates defining an upper water chamber between themselves and the wall of the cylindrical body including a water supply hole, a water tank, a water supply pipe providing communication between said water tank and said water supply hole, the lower partition plate defining a lower water chamber between itself and the bottom portion of the cylindrical body and being provided with water holes, and valves attached to said water holes which open when the pressure in the upper water chamber is raised, to flow water from the upper water chamber to the lower water chamber;

c. said water tank for supplying water to said compressive water-feed valve means being disposed at a higher position beside the compressive water-feed valve means and in operation communicating with the water supply hole of the compressive water-feed valve means through the water supply pipe;

d. a steam spouting press table situated over the steam-generating chamber and a cover plate hinged over the press table, a spring attached to said cover plate holding the cover plate spaced from said steam-spouting press table, the steam-spouting press table including a mattress member and a porous member and having a steam chamber formed with its top side by said mattress member with said porous member to spout and permeate steam through the porous member and mattress member, and a bottom plate on said steam-spouting press table provided with a steam-injection opening, and a suction opening, a conduit pipe communicating with said injection opening which leads the steam produced in the steam-generating chamber, means comprising an operating lever for opening and closing said suction opening;

e. suction means disposed beside said steam-generating chamber and connected with the suction opening on the bottom of said steam-spouting press table, a suction pipe connecting said suction means with said suction opening;

f. a waste-steam tank disposed beside the base and communicating with said suction means to store waste steam which has been sucked by the suction means; and a steam-discharge pipe connecting said suction means with said waste-steam tank.

* * * * *